CYLINDER LINER FOR RECIPROCATING-TYPE INTERNAL COMBUSTION ENGINES

BACKGROUND OF THE INVENTION

1. Field of the Invention

The present invention relates to a cylinder liner for reciprocating-piston-type internal combustion engines, with the liner of a given cylinder having a ring-shaped or annular insert that narrows the cylinder in a zone opposite the fire land (top land) of the pertaining piston when the latter is in its top dead center position.

2. Description of the Prior Art

The ring-shaped insert, which narrows the top end of the cylinder, is intended to prevent carbon from depositing on the fire land of the piston, since as the fire land slides over those parts of the cylinder (the cylinder liner) that are swept or passed over by the piston rings, such deposits tend to cause local polishing of these cylinder areas. As a result of this "bore polishing", the hydrodynamic lubrication film is disturbed due to insufficient oil adhesion; this means that the risk of ring and piston seizures and/or scoring increases as the area of these polished surfaces increases.

Ring-shaped inserts serving such a function were disclosed by the German Pat. No. 30 38 235 and the German preliminary Pat. No. 19 00 922 corresponding to U.S. Pat. No. 3,489,130—Polidan et al dated Jan. 13, 1970. However, these disclosures fail to provide simple and, at the same time, secure fastening, i.e., among other things, easy installation in, or removal from, the cylinder liner. The press fit or shrink fit of the insert described in the prior art in a recess of the liner on the one hand makes removal of the insert difficult, and, moreover, involves the danger of the insert loosening under thermal stress due to upsetting.

The latter applies also where, for instance, the insert is made of a material having a coefficient of expansion that is somewhat greater than that of the material of the cylinder liner (see German preliminary Pat. No. 19 00 922 corresponding to U.S. Pat. No. 3,489,130—Polidan et al dated Jan. 13, 1970). Furthermore, the recess provided in the liner area weakens the upper cross-sectional area of the liner. Where the insert is fitted by straight overlapping (form-locking closure), which is also described in the German preliminary Pat. No. 19 00 922, corresponding to U.S. Pat. No. 3,489,130—Polidan et al dated Jan. 13, 1970, via a lip on the cylinder head, an oscillating movement of the insert in the micro range is inevitable; where forced-locking fitting is adopted, the load is applied to the insert, and failure or separation of the liner flange or breaking away thereof can occur.

Therefore, the object of the present invention is to simplify and improve the attachment of the insert in a cylinder liner of the aforementioned general type in such a way that, in addition to easy installation and removal of the insert, no weakening of components (i.e. no weakening of the upper liner area) results and no loosening of the insert develops during operation.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
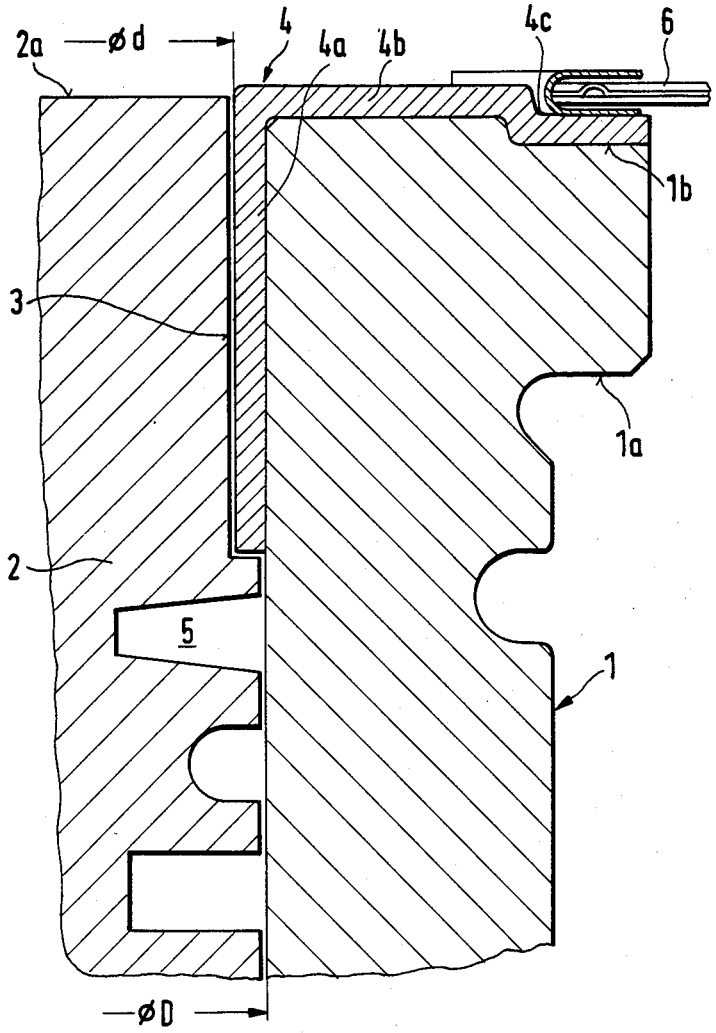
FIG. 1 is a cross-sectional view through the upper part of a cylinder/piston unit of a first exemplary inventive embodiment.
Figure 2:
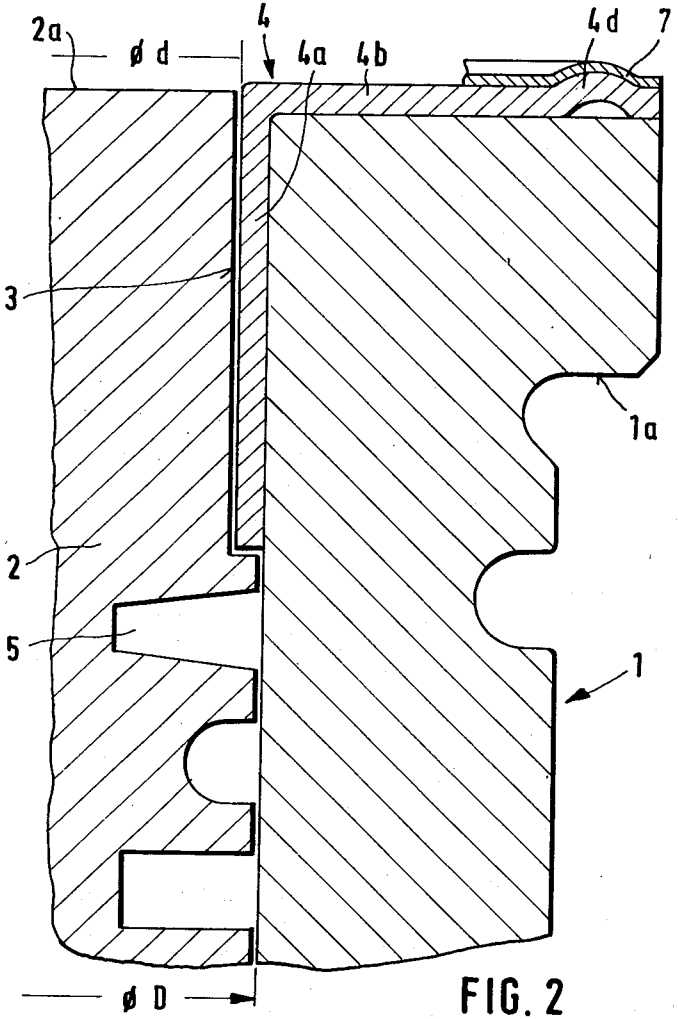
FIG. 2 is a cross-sectional view similar to that of FIG. 1 of a second exemplary inventive embodiment.
Figure 3:
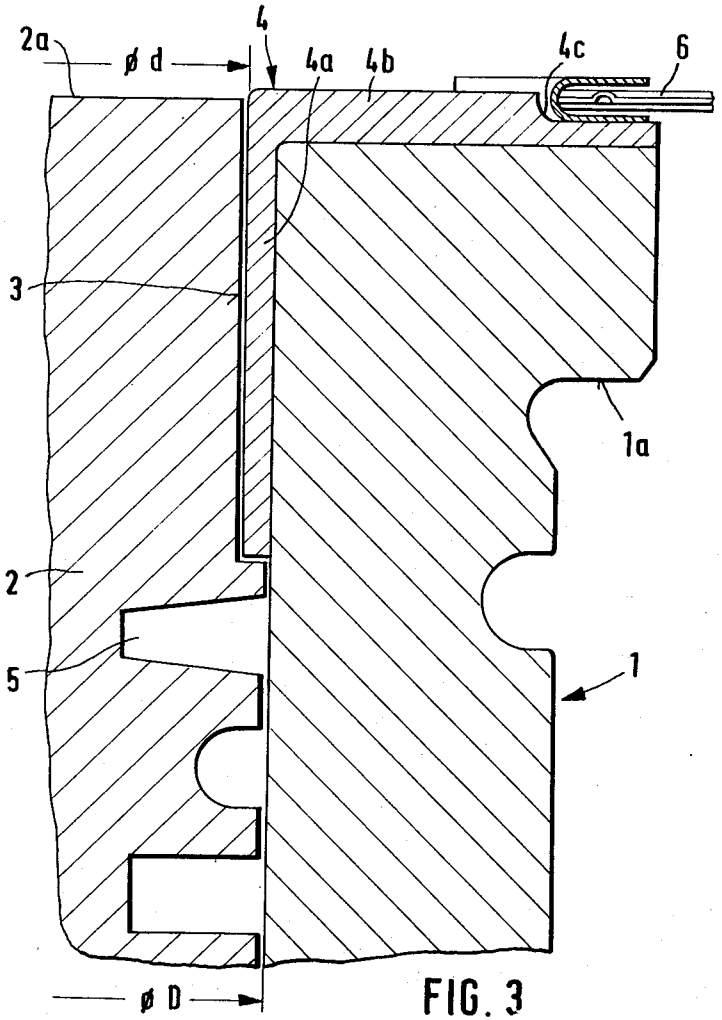
FIG. 3 is a cross-sectional view of a third exemplary inventive embodiment.

The cylinder liner of the present invention is characterized primarily in that the ring-shaped insert, which is freely placed in the cylinder in the upper region of the liner, is provided at its upper end with a flange that extends over the entire cross-sectional area of the liner, including a liner flange, if present.

Due to the freely installed insert, there is no weakening of the upper liner cross-sectional area and, apart from that, easy installation and removal are ensured. The inventive flange on the insert on the one hand ensures secure seating of the insert and, on the other hand, permits a defined force-locking effect, i.e. a force-locking effect where the force application is at the liner flange and not at the insert.

As a result, micro movements, i.e. loosening of the insert, are prevented. At the same time, there is no risk of the liner flange failing or being torn off. An added advantage is in the fact that such an insert can be readily retrofitted in production engines without any major expense, and with the design conditions being maintained.

The insert may be produced as a deep-drawn part or as a turned part. In the former case, the flange of the insert is either provided with a bead in the region of the liner flange, or in that region has a recess to accommodate the cylinder head gasket, with the recessed portion of the insert flange registering, or being accommodated, in a corresponding recess in the liner flange. Where a turned part is used, the recess in the liner flange could possibly be omitted.

Further specific features of the present invention will be described in detail subsequently.

DESCRIPTION OF THE PREFERRED EMBODIMENTS

Referring now to the drawings in detail, the reference numeral 1 in the figures denotes a cylinder liner. At the head end of the liner 1, and specifically in the region where the top or fire land 3 of the piston 2 that moves in the cylinder is situated when the piston is in the top dead center position, a ring-shaped insert 4 is inserted. The inner diameter $\phi$ d of the insert 4 is less than the bore diameter $\phi$ D of the cylinder liner 1, and the axial height 4*a* of the insert 4 extends approximately from the uppermost piston ring groove 5 to slightly above the piston crown 2*a* (corresponding to the fire land 3 of the piston 2). For better protection of the first piston ring, there is a small ridge or shoulder (not denoted by a reference numeral) between the insert 4 (4*a*) and the piston ring groove 5. The piston ring could also be "exposed". In order to assure the load capacity of the upper groove side (groove 5) in such a case, it may be useful to reduce the thickness of the insert 4 (4*a*) somewhat in this area. This may be done by chamfering or turning it down. The annular or ring-shaped insert 4 extends freely into the upper region of the cylinder; in other words, it is not accommodated in an addtional (inner) recess of the cylinder liner 1. The insert 4 is

United States Patent [19]

Foreman et al.

[11] Patent Number: 4,770,134

[45] Date of Patent: Sep. 13, 1988

[54] ENGINE PREHEATER

[75] Inventors: Joseph F. Foreman, Hannibal; John S. Rhoads, New London, both of Mo.

[73] Assignee: Watlow Industries, Inc., Hannibal, Mo.

[21] Appl. No.: 926,734

[22] Filed: Nov. 4, 1986

[51] Int. Cl.[4] ..... F02N 17/02; H05B 1/02

[52] U.S. Cl. ..... 123/142.5 R; 219/202; 237/12.3 R

[58] Field of Search ..... 237/12.3 B, 12.3 R; 126/350 A; 219/202, 208, 279, 204; 123/142.5 E, 142.5 R

[56] References Cited

U.S. PATENT DOCUMENTS

| | | | |
|---|---|---|---|
| 2,266,216 | 12/1941 | Kimberlin | 219/38 |
| 3,626,148 | 12/1971 | Woytowich | 219/208 |
| 4,208,570 | 6/1980 | Rynard | 219/208 |
| 4,245,593 | 1/1981 | Stein | 123/142.5 R |
| 4,249,491 | 2/1981 | Stein | 123/142.5 R |
| 4,591,691 | 5/1986 | Badali | 237/12.3 B X |

OTHER PUBLICATIONS

Kim Hotstart Mfg. Co., Inc., Bulletin CH-100 for Engine Pre-Heaters and Accessories; (pp. 3-10 and Front and Rear Covers).

*Primary Examiner*—Henry A. Bennett

*Attorney, Agent, or Firm*—Senniger, Powers, Leavitt and Roedel

[57] ABSTRACT

An engine preheater comprising a tubular tank adapted to be mounted generally horizontally and having an inlet adjacent one end of the tank for flow of engine coolant into the tank and an outlet adjacent the opposite end of the tank for flow of heated engine coolant out of the tank. The preheater includes an electric heating element in the tank spaced from the inlet of the tank for heating engine coolant in the tank and a temperature sensor inside the tank adjacent the inlet of the tank. The sensor is so positioned relative to the inlet and the heating element that it is adapted accurately to sense the temperature of engine coolant flowing into the tank via the inlet before the incoming engine coolant is substantially heated by the heating element.

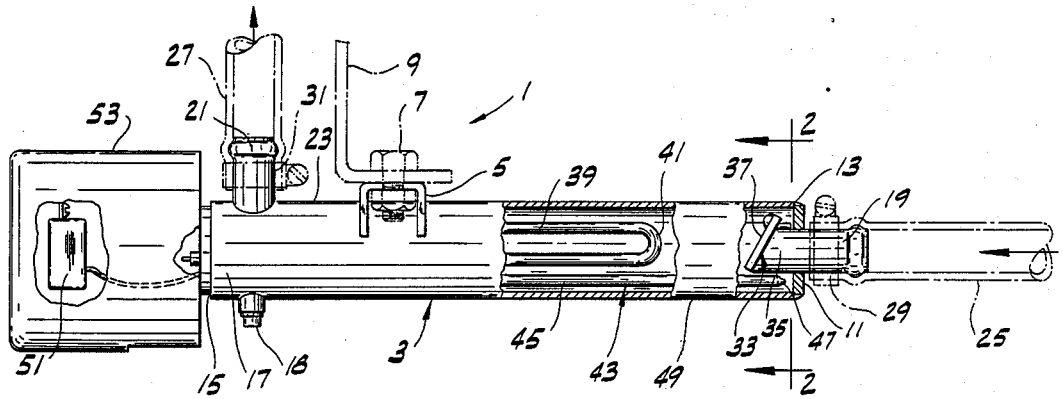

21 Claims, 1 Drawing Sheet